US008458981B2

(12) United States Patent
Kohl et al.

(10) Patent No.: US 8,458,981 B2
(45) Date of Patent: Jun. 11, 2013

(54) BLOCK WALL SYSTEM

(75) Inventors: Oliver Kohl, Eleebana (AU); Jamie Christopher Curran, Eleebana (AU); Craig Stephen Thorley, Largs (AU); Christopher Charles Rafferty, Raworth (AU)

(73) Assignee: Blockaid Pty. Ltd., New South Wales (AU)

( * ) Notice: Subject to any disclaimer, the term of this patent is extended or adjusted under 35 U.S.C. 154(b) by 0 days.

(21) Appl. No.: 12/664,712

(22) PCT Filed: Jul. 18, 2008

(86) PCT No.: PCT/AU2008/001051

§ 371 (c)(1),
(2), (4) Date: May 11, 2010

(87) PCT Pub. No.: WO2009/012519

PCT Pub. Date: Jan. 29, 2009

(65) Prior Publication Data

US 2010/0212247 A1 Aug. 26, 2010

(30) Foreign Application Priority Data

Jul. 20, 2007 (AU) ..... 2007903944

(51) Int. Cl.
*E04C 5/16* (2006.01)

(52) U.S. Cl.
USPC ..... 52/684; 52/379; 52/431; 52/565; 52/686; 52/745.1

(58) Field of Classification Search
USPC ..... 52/379, 383, 426, 428, 431, 436–439, 52/563, 565, 568, 569, 677–689, 219, 220.8, 52/745.1
See application file for complete search history.

(56) References Cited

U.S. PATENT DOCUMENTS

| | | | | | |
|---|---|---|---|---|---|
| 1,620,834 | A | * | 3/1927 | Rhodes | 52/220.1 |
| 3,145,505 | A | | 8/1964 | Cornelius | |
| 4,091,587 | A | * | 5/1978 | Depka | 52/421 |
| 4,190,999 | A | | 3/1980 | Hampton | |
| 4,831,803 | A | * | 5/1989 | Leonardis | 52/323 |
| 4,936,062 | A | * | 6/1990 | Golston et al. | 52/127.1 |
| 5,072,556 | A | * | 12/1991 | Egenhoefer | 52/126.4 |
| 5,459,971 | A | * | 10/1995 | Sparkman | 52/426 |
| 5,553,435 | A | * | 9/1996 | Eickhoff | 52/698 |
| 5,701,710 | A | * | 12/1997 | Tremelling | 52/426 |
| 5,809,728 | A | * | 9/1998 | Tremelling | 52/426 |
| 5,829,217 | A | * | 11/1998 | Colen | 52/442 |
| 5,983,585 | A | * | 11/1999 | Spakousky | 52/405.4 |
| 6,202,374 | B1 | * | 3/2001 | Cooper et al. | 52/220.3 |

(Continued)

FOREIGN PATENT DOCUMENTS

| | | | |
|---|---|---|---|
| AU | 2003201380 | A1 | 10/2003 |
| WO | WO-03/062549 | A1 | 7/2003 |

*Primary Examiner* — Brian Glessner
*Assistant Examiner* — Adriana Figueroa
(74) *Attorney, Agent, or Firm* — Tarolli, Sundheim, Covell & Tummino LLP

(57) ABSTRACT

A block wall system including a block wall having a multiplicity of courses of blocks; at least one longitudinal reinforcement bar that extends through the block wall; and at least one bracket for locating the longitudinal reinforcement bar; wherein the longitudinal reinforcement bar passes through the void of at least one block in the block wall and through a capture zone of the bracket located within the block wall.

18 Claims, 8 Drawing Sheets

U.S. PATENT DOCUMENTS

| | | | | |
|---|---|---|---|---|
| 6,571,526 | B2 * | 6/2003 | Queen | 52/677 |
| 6,732,481 | B2 * | 5/2004 | Stahl, Sr. | 52/406.1 |
| 6,978,581 | B1 * | 12/2005 | Spakousky | 52/405.4 |
| 7,007,436 | B1 * | 3/2006 | Kelley | 52/605 |
| 7,748,192 | B2 * | 7/2010 | Ryder | 52/569 |
| 2002/0112437 | A1 | 8/2002 | Queen | |
| 2007/0186504 | A1 * | 8/2007 | Gavin | 52/677 |

* cited by examiner

BLOCK WALL SYSTEM

FIELD OF THE INVENTION

This invention relates to a block wall system. In particular the invention relates to a block wall system for quickly and easily positioning reinforcement bars in a block wall.

BACKGROUND OF THE INVENTION

Concrete blocks are a very popular way in which to build walls of buildings and houses. Concrete blocks are typically formed with hollow cores or voids. Concrete block walls are cost-effective and relatively easy to build.

In order to build a concrete block wall, blocks are laid in a number of courses. During the construction of the various courses of blocks, horizontal reinforcement bars are placed along predetermined courses of blocks within the block wall. The horizontal bars require positioning in accordance with the structural requirements of the wall being constructed. Once all of the blocks are laid within the block wall, vertical reinforcement bars are then placed through the block wall. Again, the vertical bars require positioning in accordance with the structural requirements of the wall being constructed. Concrete is then poured into the voids within the block to complete construction of the block wall.

The position of the reinforcement bars within the block wall are dependent upon the structural requirements of the block wall. For example, where there is a side loading on a block wall, the vertical reinforcement bars are generally located non-centrally in the block wall and must be positioned to ensure grout cover is in compliance with industry standard. Similarly, under normal vertical load conditions, the reinforcement bar is located centrally in the block wall.

It is relatively easy to locate the horizontal reinforcement bars in a desired location. This is due mainly to the horizontal reinforcement bars being able to be viewed when they are being laid. However, in order to ensure the vertical reinforcement bars are subsequently located correctly, the horizontal reinforcement bars do require correct location within the recess provided in the top surface of the blocks. Further, there are brackets such as those described in International Patent Application No. PCT/AU2005/001455 which assist in alignment of the horizontal reinforcement bars. However, it is substantially more difficult to correctly align the vertical reinforcement bars in block walls.

The most widely used conventional method in aligning the vertical reinforcement bars has been to leave holes out of the bottom course of blocks so that the vertical reinforcement bars can be manually aligned. Hence, when the vertical reinforcement bar is lowered through the voids in the blocks of the block wall, the vertical bar can be tied in a desired position at the top and the bottom of the block wall.

The problem with this method of aligning the reinforcement bar is that it relies upon a person measuring the distance of the bar from the side wall for each of the vertical bars. This is very time consuming. Further, it also relies upon a person tying the bar which again adds a considerable amount of time in alignment of the vertical bars. It is also a requirement of masonry wall construction that the vertical bars are positioned adjacent to the previously positioned horizontal bars to create a mesh of reinforcement to provide structural strength of the completed wall. It follows then, that if the horizontal reinforcing bars have been incorrectly positioned, then the vertical reinforcing bars will be incorrectly positioned when tied to the horizontal reinforcing bars. Finally, once the vertical bars are properly aligned, the lower course of bricks must be patched for aesthetic purposes and also to prevent concrete from running out of the block wall when the voids of the block wall are filled with concrete.

OBJECT OF THE INVENTION

It is an object of the invention to overcome and/or alleviate one or more of the above disadvantages or provide the consumer with a useful or commercial choice.

It is a preferred object of the invention to provide a more structurally sound block wall by correctly locating the reinforcing bars within the wall.

SUMMARY OF THE INVENTION

In one form, the invention resides in a bracket for locating a longitudinal reinforcement bar within a block wall, the bracket comprising:

a capture zone to capture a reinforcement bar placed longitudinally through a void of a block wall; and a locator for locating said capture zone in a predetermined position with the void of the block wall.

The longitudinally positioned reinforcement bar typically is a substantially vertical reinforcement bar.

The locator may include a plurality of locating fingers for location within a void of the block wall. The locator may also include a plurality of support members to support the bracket on top of a block of a block wall.

The capture zone may be formed from an enclosed or partially enclosed aperture.

The bracket may also include a saddle for a laterally positioned reinforcement bar. The laterally positioned reinforcement bar typically is a substantially horizontal reinforcement bar.

The saddle may include one or more apertures for location of the horizontal reinforcement bar.

The bracket may also include an alignment indicator for indicating the position of the bracket within a block wall.

In another form, the invention resides in a block wall system including a block wall having:

a multiplicity of courses of blocks;

at least one longitudinally reinforcement bar that extends through the block wall; and at least one bracket for locating the longitudinal reinforcement bar;

wherein the longitudinal reinforcement bar passes through the void of at least one block in the block wall and through the capture zone of the bracket located within the block wall, In yet another form, the invention resides in a method of forming a block wall, the method including the steps of:

laying a first course of blocks;

locating the bracket within one of the blocks of the first course of blocks;

placing a second course of blocks on top of the first set of blocks; and locating a longitudinal reinforcement bar through the voids in the first and second course of blocks so that the reinforcement bar passes through a capture zone in the bracket.

BRIEF DESCRIPTION OF THE DRAWINGS

Embodiments of the invention will now be described with reference to the accompanying drawings in which.

DETAILED DESCRIPTION OF THE PREFERRED EMBODIMENT

Figure 1A:
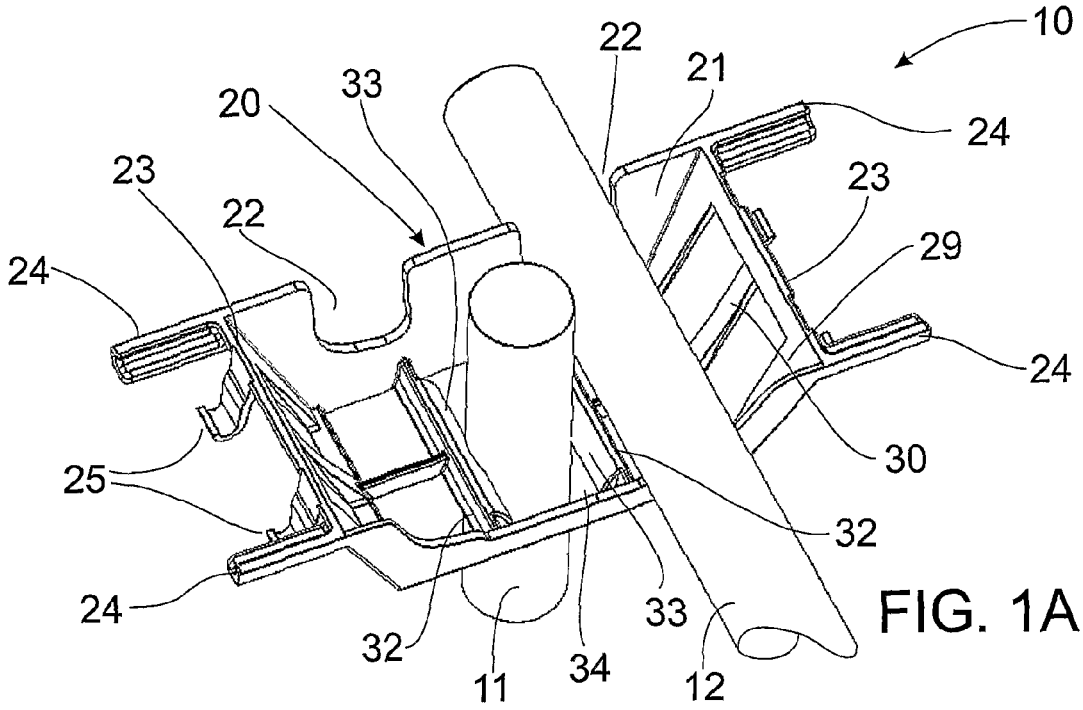
FIG. 1A is a perspective view of a bracket for the placement of reinforcement bars in a block wall according to a first embodiment of the invention.
Figure 1B:
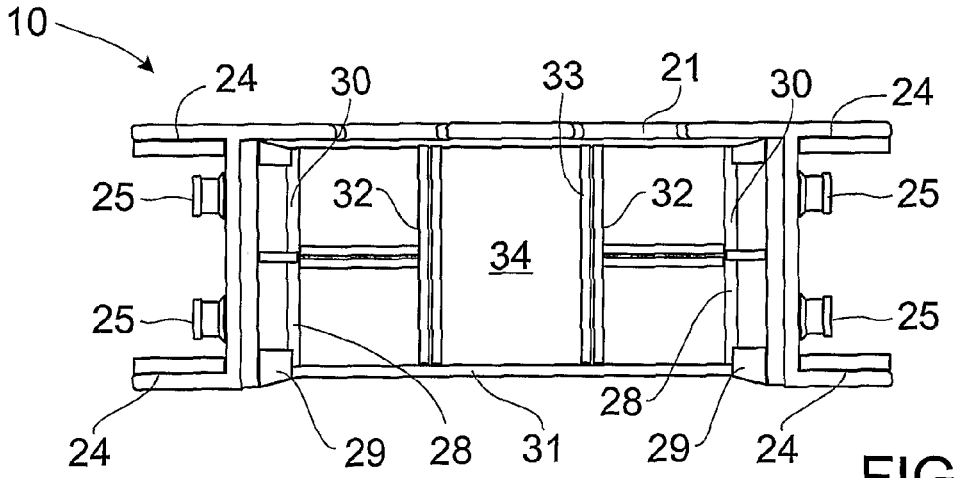
FIG. 1B is a top view of a bracket for the placement of reinforcement bars in a block wall according to FIG. 1A.
Figure 1C:
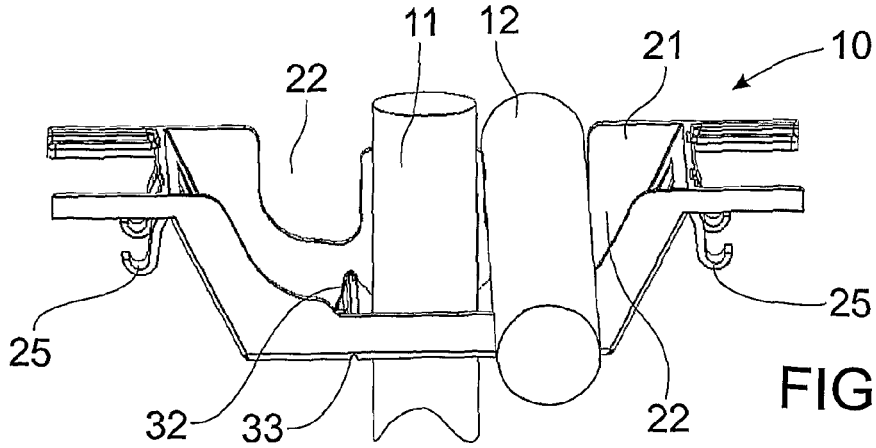
FIG. 1C is a side sectional view of a bracket for the placement of reinforcement bars in a block wall according FIG. 1A.

FIGS. 1A to 1C show a bracket 10 for positioning reinforcement bars in a block wall. The bracket 10 is able to be used in order to position both vertical reinforcement bars 11 and horizontal reinforcement bars 12. The bracket 10 is typically made from injection mould plastic and accordingly is integrally formed.

The bracket 10 has a saddle 20 that includes a face plate 21 having two saddle apertures 22 located within the face plate 21. Two cross members 23 extend outwardly from the face plate 21 adjacent respective top corners of the face plate 21. Two support members 24 extend outwardly from each end of the top cross members 23. Two locating fingers 25 extend downwardly and outwardly from each top cross member 23. The support members 24 and the locating fingers 25 form a locator to locate the bracket 10 in a void of a block.

Two bottom cross members 28 extend outwardly from respective bottom corners of the face plate 21. A side rail 29 joins each top cross member 23 and bottom cross member 28. Further a side rib 30 extends between respective top cross members 23 and bottom cross members 28. There may be one or more side ribs 30 at the ends of bracket 10. A front rail 31 extends across the front of the bracket 10 and extends between the side rails 29. Front rail 31 may also include a top profile to further support the horizontal reinforcement bars 12. Cross rails 32 extend outwardly from the face plate 21 to the front rail 31. Two locating flaps 33 are hinged to respective cross rails. A capture zone in the form of a capture aperture 34 is located between the locating flaps 33.

Figure 2A:
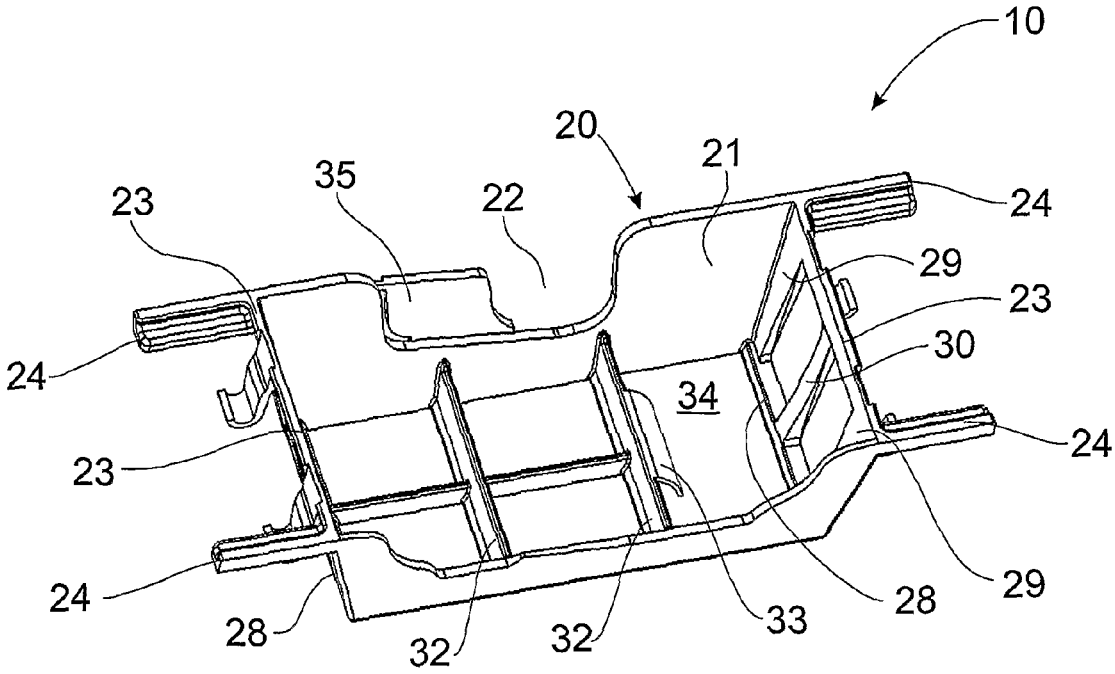
FIG. 2A is a perspective view of a bracket for the placement of reinforcement bars in a block wall according to a second embodiment of the invention.
Figure 2B:
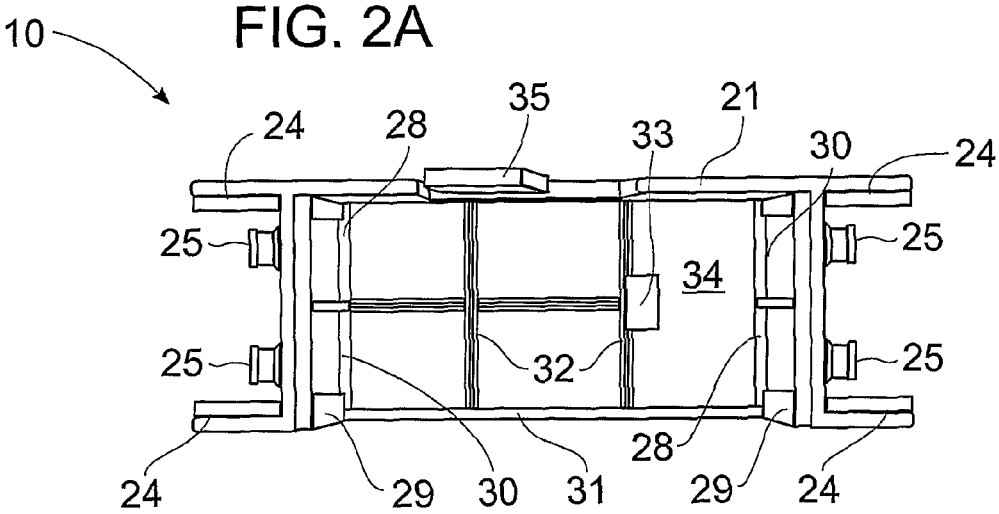
FIG. 2B is a top view of a bracket for the placement of reinforcement bars in a block wall according to FIG. 2A.
Figure 2C:
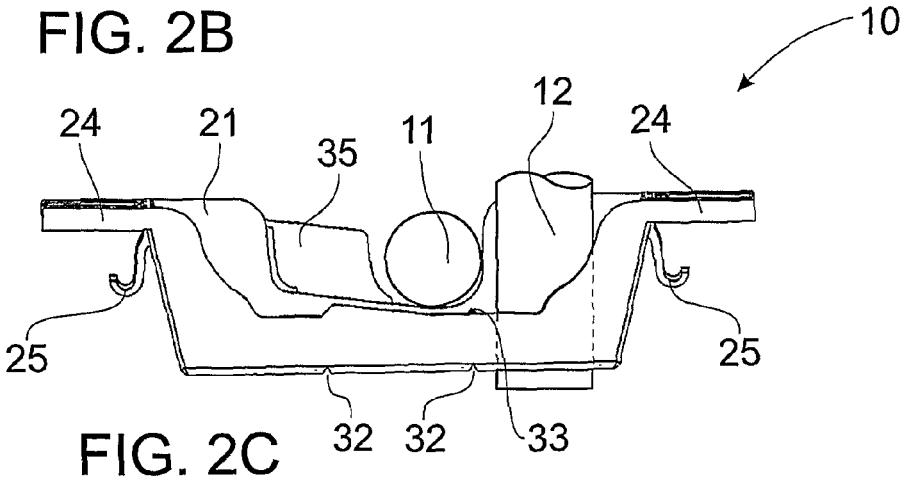
FIG. 2C is a side sectional view of a bracket for the placement of reinforcement bars in a block wall according to according to FIG. 2A.

FIGS. 2A to 2C show a variation on the bracket shown in FIGS. 1A, 1B and 1C. Like reference numerals have been used to describe like features in this embodiment.

The bracket 10 shown in FIGS. 2A to 2C is for use in a block wall that has a side loading. The bracket 10 is able to be used in order to position both vertical reinforcement bars 11 at the required distance adjacent to the outside of the block and horizontal reinforcement bars 12. Accordingly, there is only a single locating flap 33 hinged to a cross rail 32 and the capture aperture 34 is located between the locating flap 33 and the bottom cross member 28. Further, the face plate 21 has only a single saddle aperture 22. A frangible tab 35 is located within the face plate 21 so that a larger horizontal reinforcement bar 11 may be located within an enlarged saddle aperture 22 or alternatively so that two horizontal reinforcement bars 11 may be located within an enlarged aperture 22 such as when horizontal bars are overlapped when joining of two horizontal bars is required.

Figure 3:
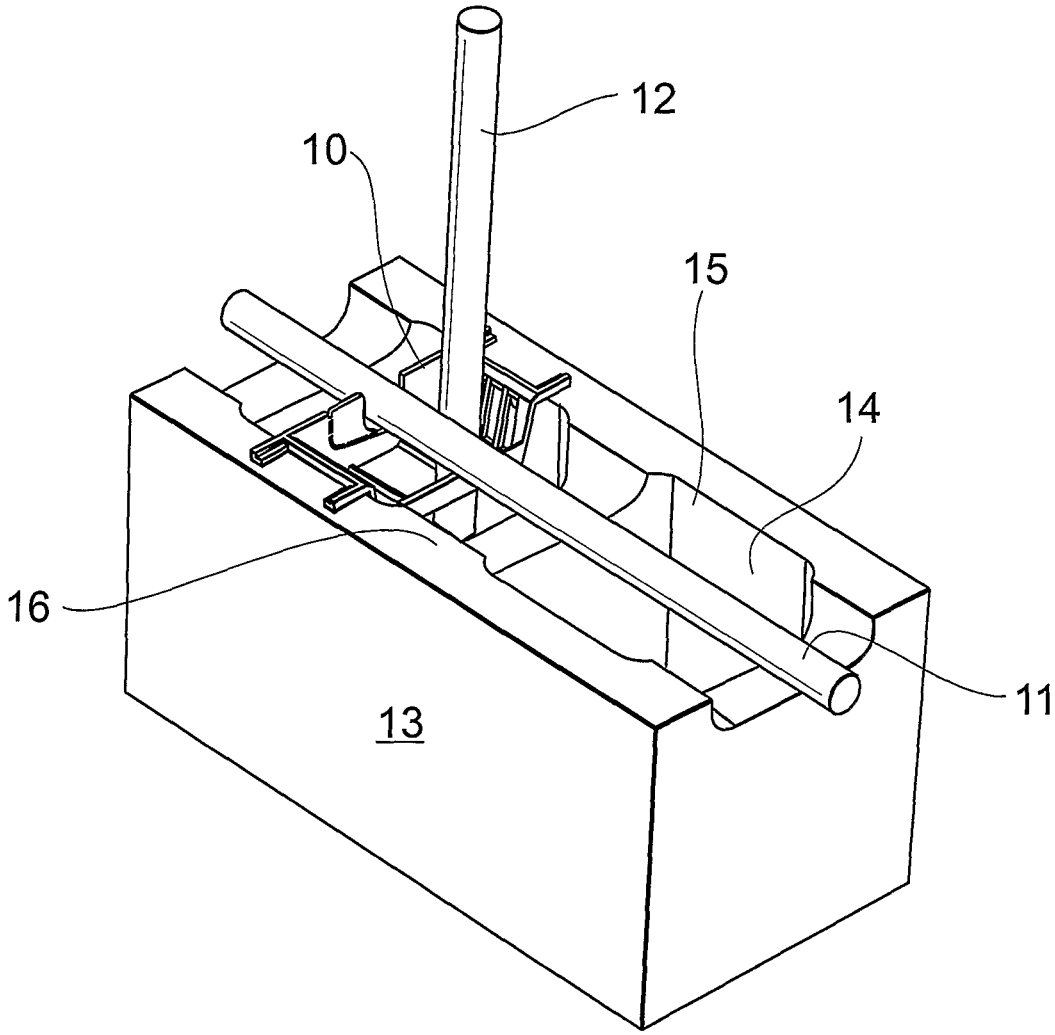
FIG. 3 is a perspective view of the bracket of FIG. 2A located within a block.

FIG. 3 shows a perspective view of the bracket 10 shown in FIGS. 2A to 2C located within a concrete block 13. The bracket 10 is located within a void 14 of the concrete block 13 such that the two locating fingers 25 engage with an inner wall 15 of the concrete block 13. The locating fingers 25 laterally locate the bracket 10 in the desired location within the void of the concrete block. The bracket 10 is pushed into the void until the two support members 24 contact an upper surface 16 of the concrete block 13. This ensures that the bracket 10 is inserted to a predetermined depth within the void 14 of the concrete block 13 and provides support for bracket 10 when horizontal reinforcement bars 11 are located in the saddle apertures 34.

Figure 4A:
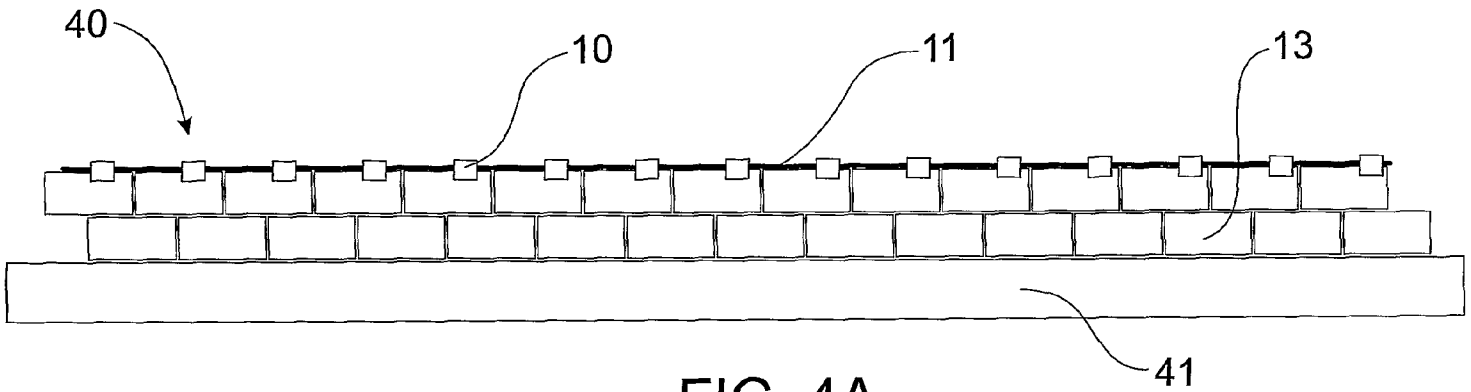
FIG. 4A is schematic view of a partially completed block wall having a single horizontal reinforcement bars.
Figure 4B:
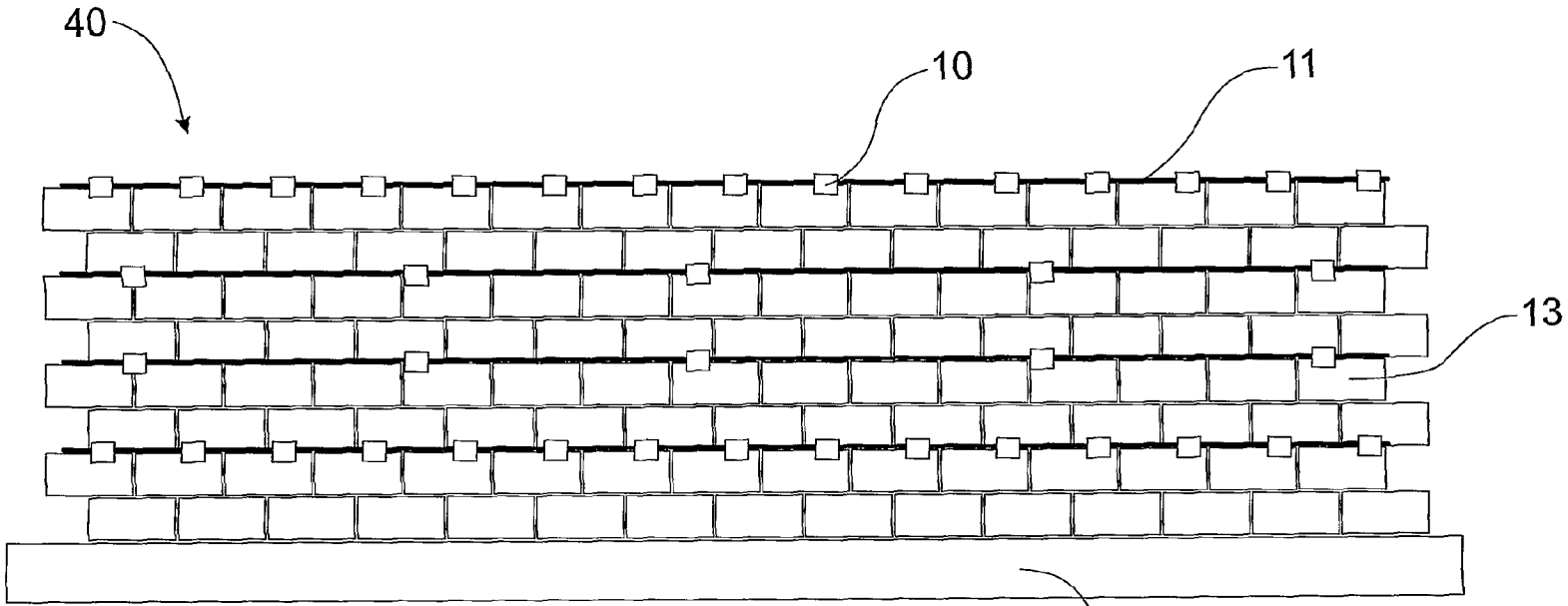
FIG. 4B is schematic view of a further partially completed block wall with several horizontal reinforcement bars.
Figure 4C:
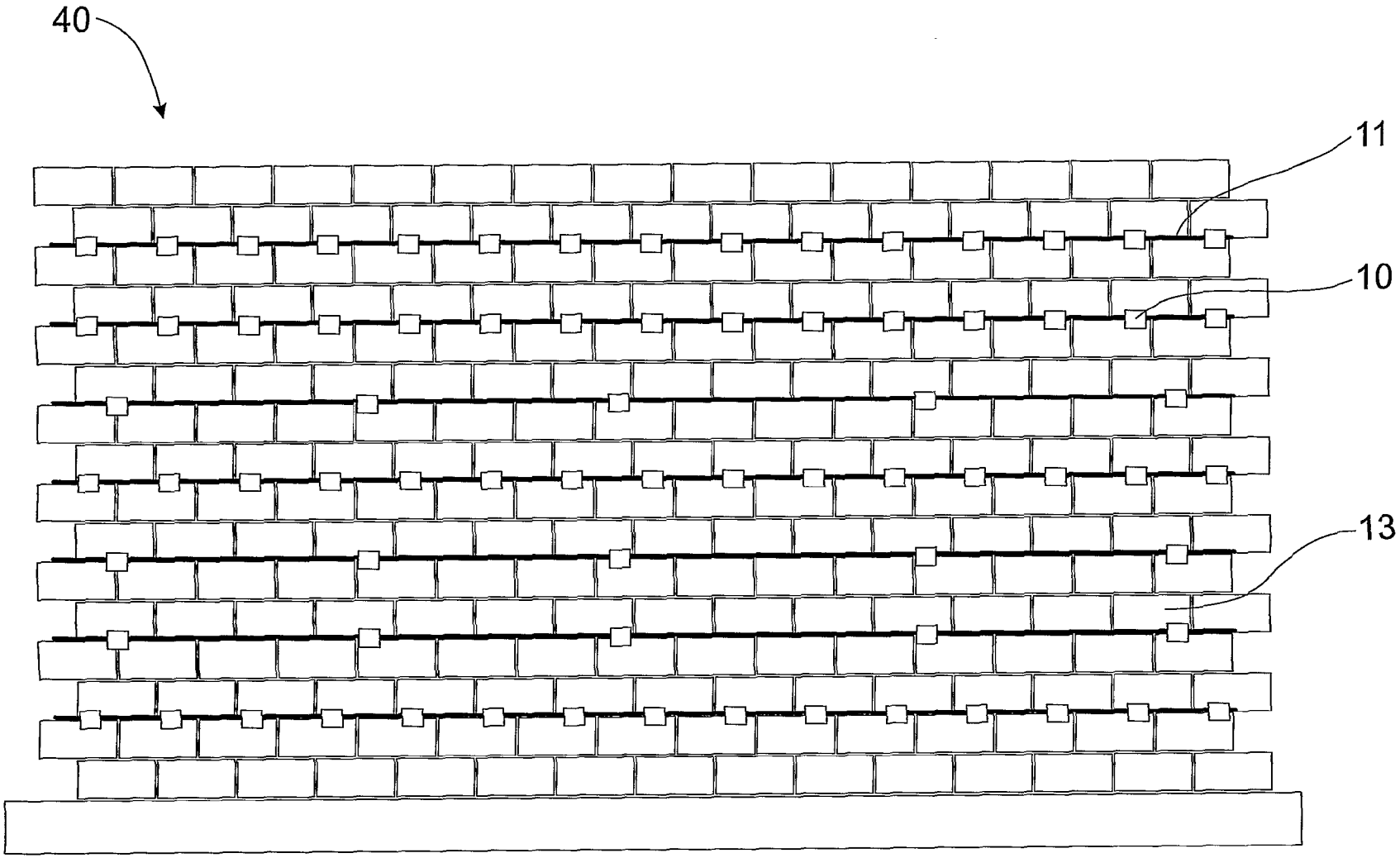
FIG. 4C is schematic view of a partially completed block wall with all horizontal reinforcement bars.
Figure 4D:
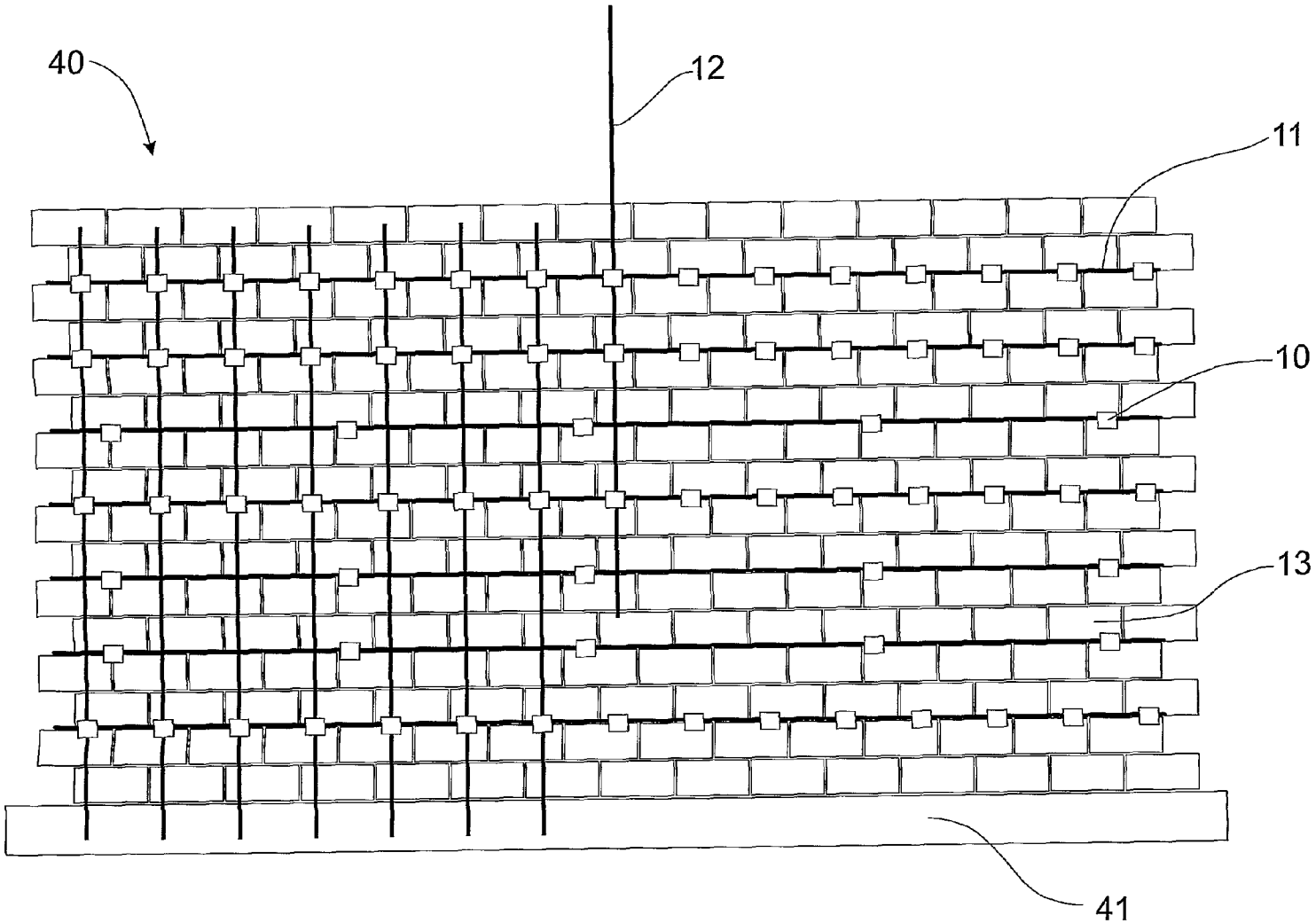
FIG. 4D is schematic view of a partially completed block wall with all horizontal reinforcement bars and several vertical reinforcement bars.
Figure 4E:
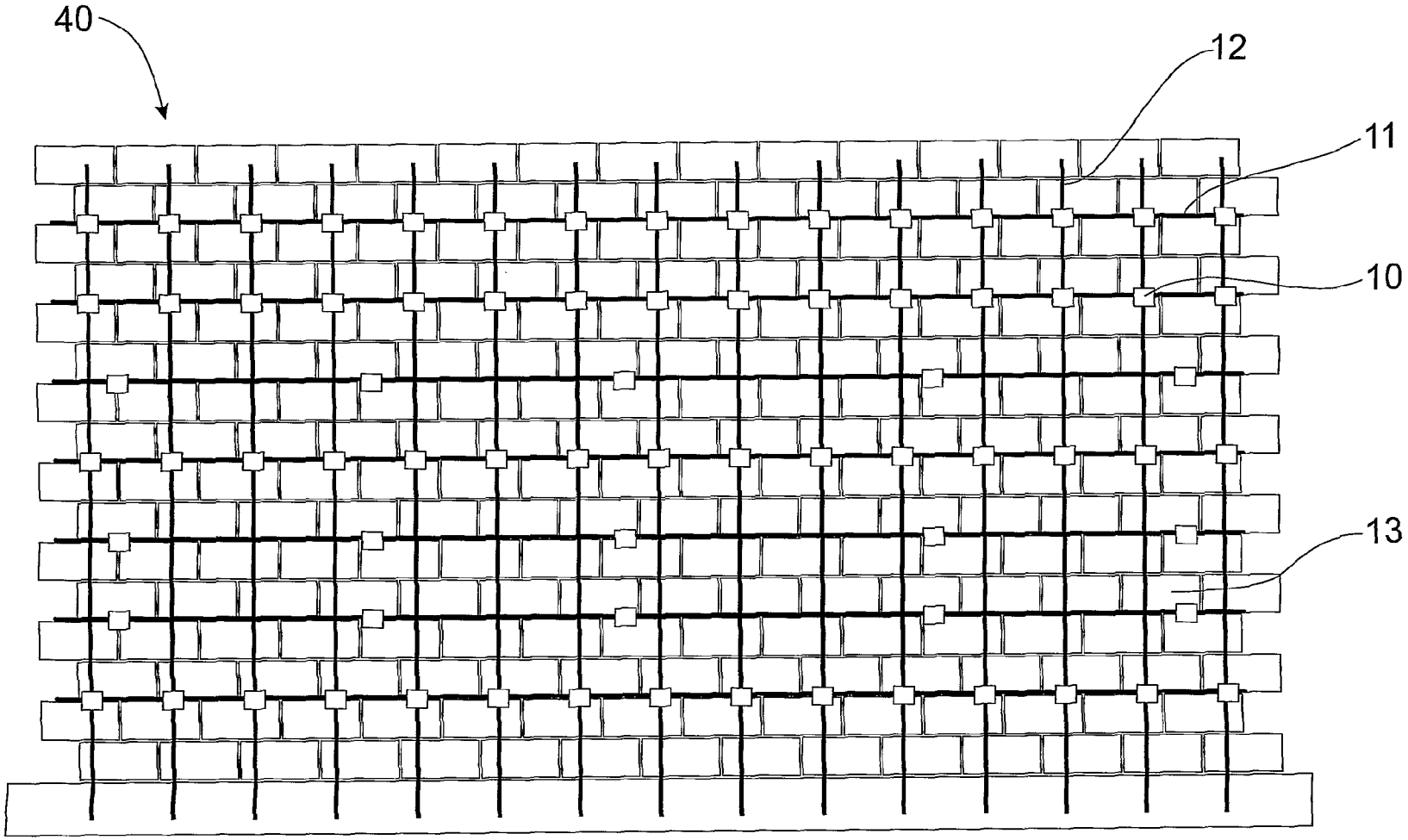
FIG. 4E is schematic view of a completed block wall with all horizontal reinforcement bars and all vertical reinforcement bars.

The bracket 10 is used to locate both horizontal reinforcement bars 11 and vertical reinforcement bars 12 as shown in FIG. 3. FIGS. 4A to 4E show the method of building a concrete block wall 40 using the brackets 10. In use, a number of courses of concrete blocks 13 are built on a concrete footing 41. Brackets 10 are inserted into voids of blocks 13 typically on the second course. The support members 24 and the locating fingers 25 ensure that the saddle apertures 34 located within the face plate 21 are in horizontal alignment. A horizontal reinforcement bar 11 is then located into the saddle apertures 34 as shown in FIG. 4A. This process is repeated at regular intervals, as shown in FIG. 4B, until all of the horizontal reinforcement bars 11 are located within a block wall of a desired height as shown in FIG. 4C.

Once the horizontal reinforcement bars 11 are located within the block wall 40 of a desired height, vertical reinforcement bars 12 are required to be inserted into the block wall 40. This is achieved by inserting the vertical reinforcement bar 12 through the capture apertures 34 in the each bracket 10. The capture apertures 34 provide a specified area which restrains the movement of the vertical reinforcement bar 11 to the specified area. The position of the capture aperture 34 will vary between brackets 10 depending on the desired use of the bracket 10. For example, the capture aperture in FIG. 1A is used for block walls under vertical loading conditions whilst in FIG. 2B the capture aperture 34 is used in walls with side loading conditions.

During construction of the block wall 40, a vertical reinforcement bar 12 is inserted through the capture apertures 34 of the brackets 10 that are in vertical alignment. The locating flaps 33 on each bracket 10 ensure that the vertical reinforcement bar 12 is positioned correctly within the capture apertures 34 for varying diameters of reinforcement bars. This process is repeated for each of the vertically aligned brackets 10 where vertical reinforcement bars 32 are required. Once all the vertical reinforcement bars 12 have been positioned within the block wall, concrete is used to fill the block wall.

To assist in the placement of vertical reinforcement bars 32 brackets 10 may be produced in a bright colour to increase their visibility when looking down the block voids.

Figure 5A:
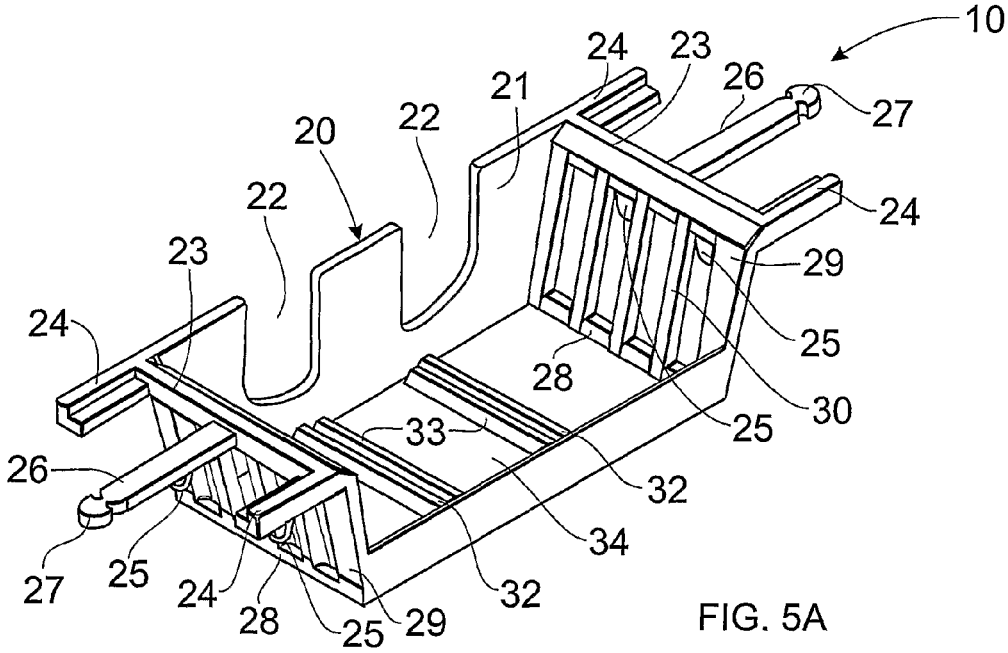
FIG. 5A is a perspective view of a bracket for the placement of reinforcement bars in a block wall according to a third embodiment of the invention.
Figure 5B:
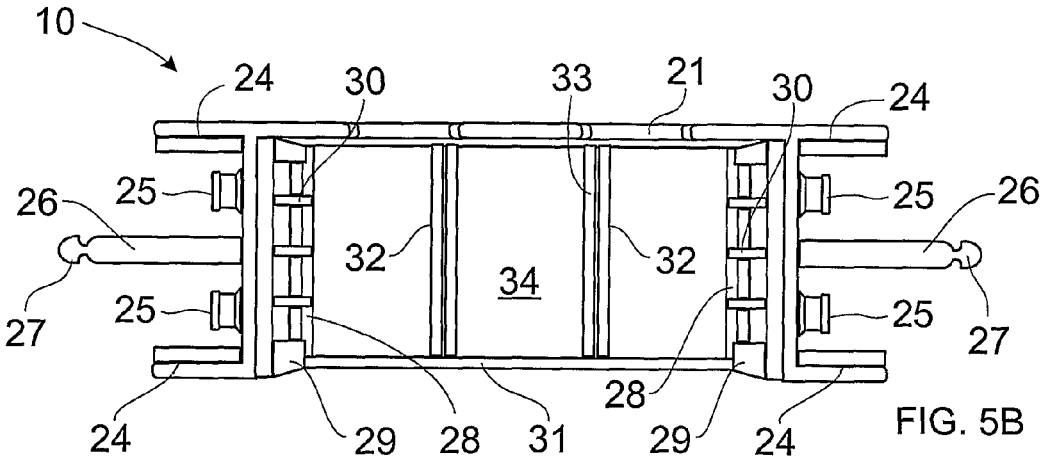
FIG. 5B is a top view of a bracket for the placement of reinforcement bars in a block wall according to FIG. 5A.
Figure 5C:
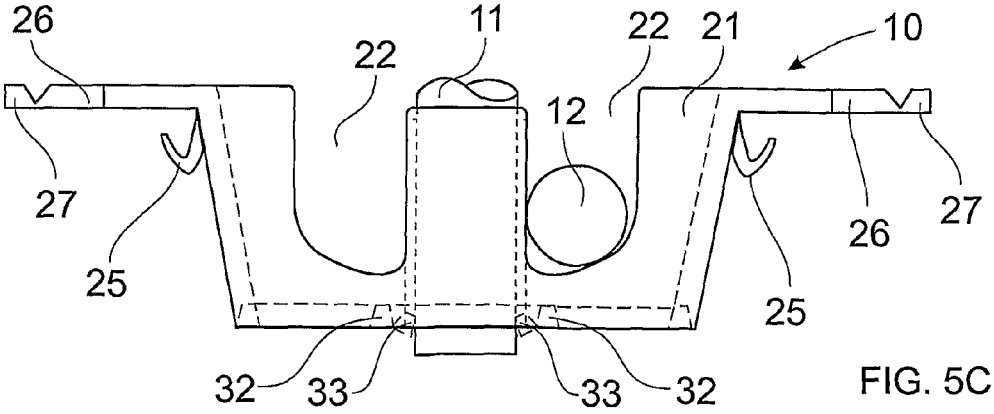
FIG. 5C is a side view of a bracket for the placement of reinforcement bars in a block wall according FIG. 5A.

FIGS. 5A to 5C show a variation on the bracket shown in FIGS. 1A, 1B and 1C. Like reference numerals have been used to describe like features in this embodiment. In this embodiment, the bracket 10 includes an alignment member 26 that extends outwardly from each top cross member 23 and is located between respective support members 24. A removable nib 27 is located at the end of each alignment member 26.

When placing the brackets 10 shown in FIGS. 5A to 5C in the block wall 40, the removable nib 27 of the alignment member 26 is visible in a block wall as the removable nib 27 protrudes between the blocks of the block wall. Accordingly, where a vertical reinforcement bar 12 is required to be placed within a completed block wall, the brackets 10 are more easily vertically aligned using the removable nib 27 of the alignment member 26. A trowel or other implement can then be used to run over the block wall to break the removable nibs 27 from the alignment member 26 if desired when the block wall has been completed.

The bracket 10 provides an advantage as both horizontal and vertical reinforcement bars can be quickly and easily positioned within a block wall 40 with limited skill. Further, block walls can be produced without the need for blocks being removed in the lower course of blocks. This saves time and hence, costs.

It should be appreciated that various other changes and modifications may be made to the embodiment described without departing from the spirit or scope of the invention.

The invention claimed is:

1. A bracket for locating a longitudinal reinforcement bar within a block wall, the bracket comprising:

a capture zone, including at least one hinged locating flap, to capture the longitudinal reinforcement bar placed longitudinally through a void of a block of the block wall, the capture zone being formed from an aperture, the at least one hinged locating flap including a first longitudinal edge hinged along the bracket and a second longitudinal edge extending freely into and moving within the aperture to accommodate the longitudinal reinforcement bar; and a locator for locating said capture zone in a predetermined position with the void of the block;

wherein the locator includes a plurality of locating fingers which engage an inner wall of the void of the block and a plurality of support members to support the bracket on top of the block of the block wall.

2. The bracket of claim 1 wherein the bracket includes a saddle having at least one saddle aperture for positioning a lateral reinforcement bar.

3. The bracket of claim 1 wherein the bracket includes at least one alignment indicator for indicating the position of the bracket within the block wall.

4. The bracket of claim 3 wherein the alignment indicator includes a removable nib.

5. The bracket of claim 1 wherein the locating flap is elastically deformable and applies a biasing force upon the longitudinal reinforcement bar in order to locate the longitudinal reinforcement bar relative to the block wall.

6. The bracket of claim 1 wherein the at least one hinged locating flap comprises a pair of flexible locating flaps positioned on opposite sides of the aperture.

7. A block wall system including a block wall having:

a multiplicity of courses of blocks;

at least one longitudinal reinforcement bar that extends through the block wall; and at least one bracket for locating the longitudinal reinforcement bar, the bracket including a plurality of locating fingers which engage an inner wall of a void of a block of the block wall and a plurality of support members which support the bracket on top of the block of the block wall;

wherein the longitudinal reinforcement bar passes through the void of at least one block in the block wall and through a capture zone, including at least one hinged locating flap, of the bracket located within the block wall, the at least one hinged locating flap including a first longitudinal edge hinged along the bracket and a second longitudinal edge extending freely into and moving within the aperture to accommodate the longitudinal reinforcement bar.

8. The block wall system of claim 7 including a lateral reinforcement bar that extends through the block wall.

9. The block wall system of claim 7 wherein the lateral reinforcement bar is supported by the bracket.

10. The block wall system of claim 7 wherein the capture zone is formed from an aperture.

11. The block wall system of claim 8 wherein the bracket includes a saddle for positioning the lateral reinforcement bar.

12. The bracket of claim 7 wherein the locating flap is elastically deformable and applies a biasing force upon the longitudinal reinforcement bar in order to locate the longitudinal reinforcement bar relative to the block wall.

13. The bracket of claim 7 wherein the at least one hinged locating flap comprises a pair of flexible locating flaps positioned on opposite sides of the capture zone.

14. A method of forming a block wall, the method including the steps of:

laying a first course of blocks;

locating a bracket within one of the blocks of the first course of blocks;

engaging a plurality of locating fingers of the bracket with an inner wall of a void of the block and placing a plurality of support members of the bracket on top of the block;

placing a second course of blocks on top of the first set of blocks;

locating a longitudinal reinforcement bar through the voids in the first and second course of blocks so that the reinforcement bar can pass through a capture zone formed by an aperture, including at least one hinged locating flap having a first longitudinal edge hinged along the bracket and a second longitudinal edge extending freely into and moving within the aperture to accommodate the longitudinal reinforcement bar; and engaging the second longitudinal edge of the at least one hinged locating flap with the longitudinal reinforcement bar to cause hinged deflection of the at least one hinged locating flap to allow passing of the lateral reinforcement bar through the capture zone.

15. The method of claim 14 further including the step of locating a lateral reinforcement bar on the bracket so that the bracket supports the lateral reinforcement bar.

16. The method of claim 15 further including the step of locating the lateral reinforcement bar on a saddle of the bracket, the saddle being positioned to not impede placement of the longitudinal reinforcement bar through the capture zone.

17. The method of claim 14 wherein the locating flap is elastically deformable and applies a biasing force upon the longitudinal reinforcement bar in order to locate the longitudinal reinforcement bar relative to the block wall.

18. The method of claim 14 wherein the at least one hinged locating flap comprises a pair of flexible locating flaps positioned on opposite sides of the aperture.

* * * * *